United States Patent [19]

Winfree et al.

[11] Patent Number: 4,481,047

[45] Date of Patent: Nov. 6, 1984

[54] HIGH MODULUS SHAFTS

[75] Inventors: Jules P. Winfree, Jupiter; Herbert A. Chin, West Palm Beach; Thomas E. O'Connell, North Palm Beach, all of Fla.

[73] Assignee: United Technologies Corporation, Hartford, Conn.

[21] Appl. No.: 421,673

[22] Filed: Sep. 22, 1982

[51] Int. Cl.[3] ..... C22C 19/03; C21D 7/00

[52] U.S. Cl. ..... 148/429; 148/11.5 N; 148/11.5 P

[58] Field of Search ..... 148/11.5 N, 11.5 P, 148/429, 404, 427; 420/460

[56] References Cited

U.S. PATENT DOCUMENTS 3,982,973 9/1976 Peters et al. ..... 148/11.5 N 4,110,131 8/1978 Gessinger ..... 148/11.5 N 4,328,045 5/1982 Pearson et al. ..... 148/404

*Primary Examiner*—L. Dewayne Rutledge

*Assistant Examiner*—Robert L. McDowell

*Attorney, Agent, or Firm*—Charles E. Sohl

[57] ABSTRACT

High modulus turbine shafts are described as are the process parameters for producing these shafts. The shafts have a high modulus as a result of having high <111> texture in the axial direction. The shafts are produced from a nickel base material having a strengthening phase and a moderate to high stacking fault energy. A combination of hot axisymmetric deformation followed by cold axisymmetric deformation produces an intense singular <111> texture and results in shaft material whose modulus is on the order of 25% greater than that of the steel materials used in the prior art.

6 Claims, 6 Drawing Figures

HIGH MODULUS SHAFTS

DESCRIPTION

Technical Field

This invention relates to high modulus shafts and methods for producing the same.

Background Art

Power transmission shafts are used in many types of equipment. This invention was developed particularly with respect to turbine engine shafts and will be so described. The invention, however, is not limited to gas turbine engines.

As commonly constructed, the gas turbine engine includes a hollow casing upon which are mounted rows of stationary vanes and a rotating shaft located within the hollow casing upon which are mounted disks at whose extremities are mounted a plurality of blades. The construction is such that alternately arranged rows of stationary blades and vanes serve to first compress air and later to absorb energy produced by burning fuel with previously compressed air. Critical to the efficiency of such engines is the maintenance of minimum clearances between the moving and stationary parts. The function of the turbine shaft is to mount the disks and blades for rotation and to transmit power from the turbine section of the engine to the compressor section of the engine. Successful efficient operation requires accurate location of the blades relative to the case. It is of the utmost importance that the turbine shaft be stiff and free from deflection and vibration. The stresses which produce deflection and vibration can result from the internal engine operation as well as from externally applied loads resulting from motion of the aircraft.

Conventionally produced turbine shafts are fabricated from alloy steel and are produced in hollow form in order to derive the maximum degree of (specific) stiffness.

The deflection underload of articles such as turbine shafts is inversely proportional to the modulus of elasticity, or Young's modulus. Consequently, it is desirable to employ a material having the highest possible modulus of elasticity.

Metallic materials generally have a crystalline form, that is to say, individual atoms of the material have predictable relationship to their neighboring atoms and this relationship extends in a repetitive fashion throughout a particular crystal or grain. Nickel base superalloys have a face centered cubic structure. The properties of such crystals vary significantly with orientation.

Most metallic articles contain many thousands of individual crystals or grains and the properties of such an article in a particular direction are reflective of average orientation of the individual crystals which make up the article. If the grains or crystals have a random orientation then the article properties will be isotropic, that is equal in all directions. Although widely assumed, this is rarely the case since most casting and forming processes produce a preferred crystal orientation or texture. In a deformation situation, such preferred orientation results from several factors. Crystals in certain orientations are more resistant to deformation than are other crystals. These deformation resistant oriented crystals tend to rotate during deformation, thereby producing a preferred orientation. During recrystallization, preferred orientations result from the preferential nucleation and/or growth of grains of certain orientations.

Textures have been extensively studied and some practical uses have been made of textured materials. Particularly in the area of magnetic materials such as transformer steels, texturizing has produced substantial performance enhancements. This is described, for example, in U.S. Pat. No. 3,219,496 and in an article in *Metal Progress,* Dec. 1953, pps. 71–75.

Metals that have undergone extensive deformation often display a "fibrous" macrostructure, especially when etched. Such a structure results from the alignment of inclusions, grain boundaries and second phases, but has no correlation with the crystallographic texture of the material, and should not be confused with the present invention.

It is an object of this invention to describe processing sequences which, when applied to a certain class of materials, can increase the Young's modulus or modulus of elasticity in the axial direction by as much as 25%.

It is also an object of this invention to describe the resultant high stiffness shafts.

Disclosure of Invention

According to the present invention, nickel base alloys of a particular composition having a strengthening second phase and a moderate to high stacking fault energy are processed by a combination of hot axisymmetric deformation and cold axisymmetric deformation to produce a product having a high modulus of elasticity in a predetermined direction.

The foregoing, and other features and advantages of the present invention, will become more apparent from the following description and accompanying drawings.

BEST MODE FOR CARRYING OUT THE INVENTION

The present invention relates to articles such as power transmission shafts and describes the fabrication of such shafts utilizing a combination of starting material composition and processing parameters.

It is difficult to precisely describe the requirements for materials which will, in combination with the invention processing, produce the required high elastic modulus. It appears that materials are preferably nickel base alloys having substantial quantity (i.e. greater than about 30 volume percent) of a strengthening phase of the gamma prime type where gamma prime is a compound of the type $Ni_3X$, where X may be aluminum, titanium, tantalum, and the like. It is also essential that the material have a moderate to high stacking fault energy. Stacking fault energy is a material property which affects the behavior of dislocations within the material and strongly affects the texture produced by deformation of the material.

Figure 1A:
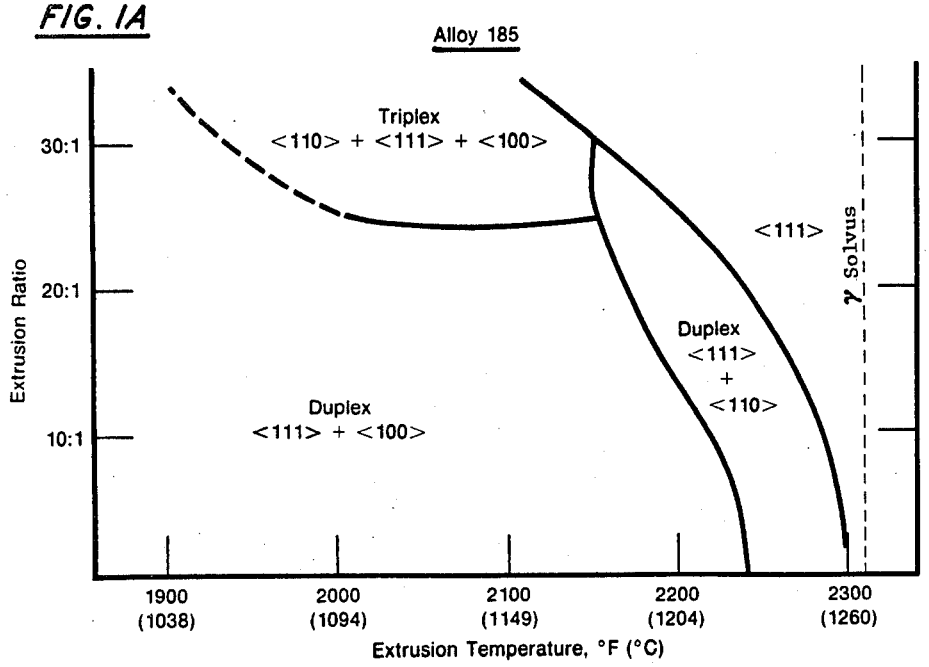
FIG. 1A and 1B show textures as a function of deformation amount and deformation temperature for two materials having different stacking fault energies.
Figure 1B:
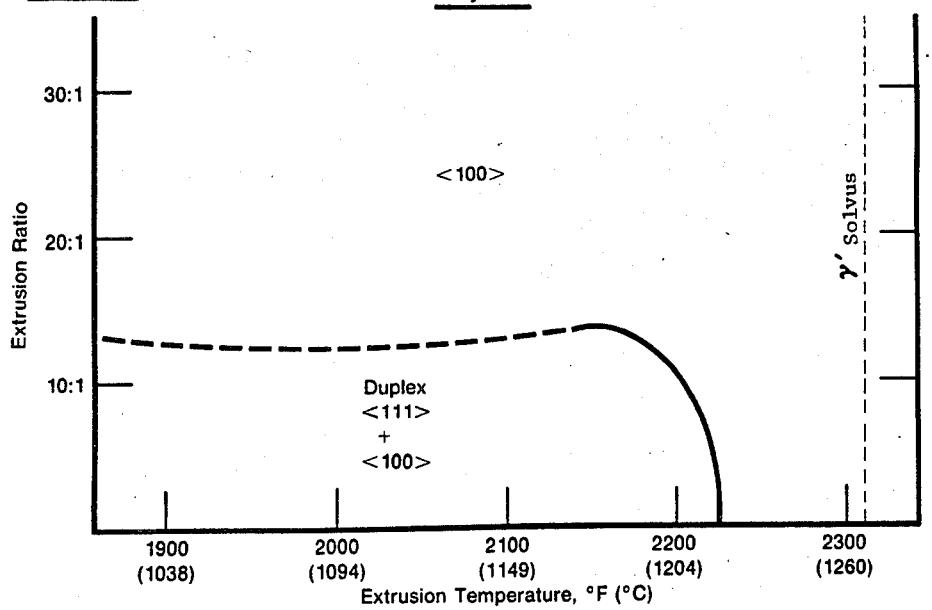

The present invention achieves high stiffness by developing a strong <111> texture in the axial direction of the shaft. This texture is developed by a combination of hot and cold axisymmetric deformation of the starting material. FIG. 1A and 1B illustrate the effect of stacking fault energy on the texture developed by deformation of two different materials. Alloy 185 is a high stacking fault energy alloy which exemplifies those alloys which are useful in connection with the present invention. It can be seen that combinations of high extrusion ratios and high temperatures produce the desired <111> texture. On the other hand, the alloy described as 116 has a low stacking fault energy and no combination of extrusion ratio and extrusion temperature will produce the necessary singular <111> texture.

As previously indicated, a moderate to high stacking fault energy is required. Unfortunately, stacking fault energy, while having a well defined physical meaning, is difficult to measure and different measurement techniques will produce different values of stacking fault energy for the same material. Indeed, many techniques for measuring stacking fault energy often yield different results when performed by different investigators. For this reason, it is not practical to describe the required stacking fault energy in a numerical sense, however, it is possible to describe an alloy whose stacking fault energy is a borderline energy, such that in order to accomplish the desired results of the present invention really requires an alloy having a higher stacking fault energy. Thus, one skilled in the art can produce this alloy, measure its stacking fault energy, and measure the stacking fault energy of any desired alloy and by comparison, determine whether his intended alloy has the requisite stacking fault energy. This alloy is the alloy described as Alloy 607 in Table I, which also lists the composition of various other alloys which will be referred to in the present application.

Beyond indicating that a moderate to high stacking fault energy is required, a stacking fault energy greater than the stacking fault energy of Alloy 607, it may be said that greater than about 6% molybdenum appears necessary in the alloy to result in the desired stacking fault energy. It appears that the broad composition range of 6–18% molybdenum, 0–10% chromium, 3–10% aluminum, 0–10% tungsten, 0–6% tantalum, 0–6% columbium, encompasses the alloys which are useful with the present invention. Further, it appears that an equation of the type $X=2\,Mo+Ta+Cb+1.5\,Al$ will (very) approximately predict suitability for use in the present invention, and that alloys for which the value of this equation ranges from about 40 to about 55 will, in general, have the required stacking fault energy.

Figure 2:
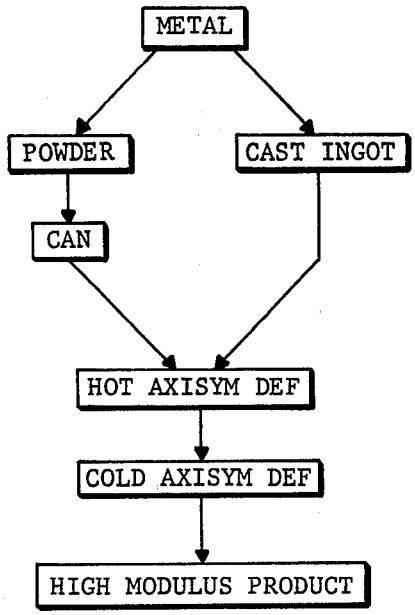
FIG. 2 is a processing flow chart illustrating the steps for alternate embodiments of the present invention.

The starting alloy may be in the form of powder or a casting. The various processing steps required to arrive at the final product are shown in FIG. 2. If the material is in powder form, the first step is to place the powder in an evacuated deformable metal can. In the case starting with an ingot material, however, this step is unnecessary. The next step then, is to deform the material in an axisymmetric fashion at a temperature and deformation amount which will produce the desired singular <111> texture. If the starting material is in powder form, the deformation will also consolidate and bond the powder into a solid body. The term axisymmetric deformation describes a deformation process which is symmetric about an axis. For example, extrusion, drawing and swaging are generally axisymmetric deformation processes. The axis about which the deformation is performed will correspond to the axis along which the <111> texture will be developed.

Referring back to FIG. 1, the behavior of Alloy 185 typifies the behavior of the alloys to which the invention is applicable so that deformation at temperatures near but below the gamma prime solvus is required, and that increasing the extrusion ratio will permit one to operate further below the gamma prime solvus temperature and still produce the desired <111> texture. A total extrusion ratio in excess of 10:1, and preferably in excess of 15:1, appears to be necessary to derive a strong <111> texture (where the starting material is powder, the higher extrusion ratios are preferred).

The initial step in the deformation is a hot deformation step designed to produce a singular <111> texture. The second step is a cold deformation step which intensifies the <111> texture. Again, the cold deformation step is an axisymmetric operation (extrusion, swaging or drawing), and is performed below about 500° F. (260° C.). The amount of deformation required in the cold deformation step will be equivalent to that which would produce a 30% reduction in cross section or greater. The resultant article will have a <111> texture intensity in the axial direction which is at least 5 times that which would be observed in a non-textured material.

Figure 3:
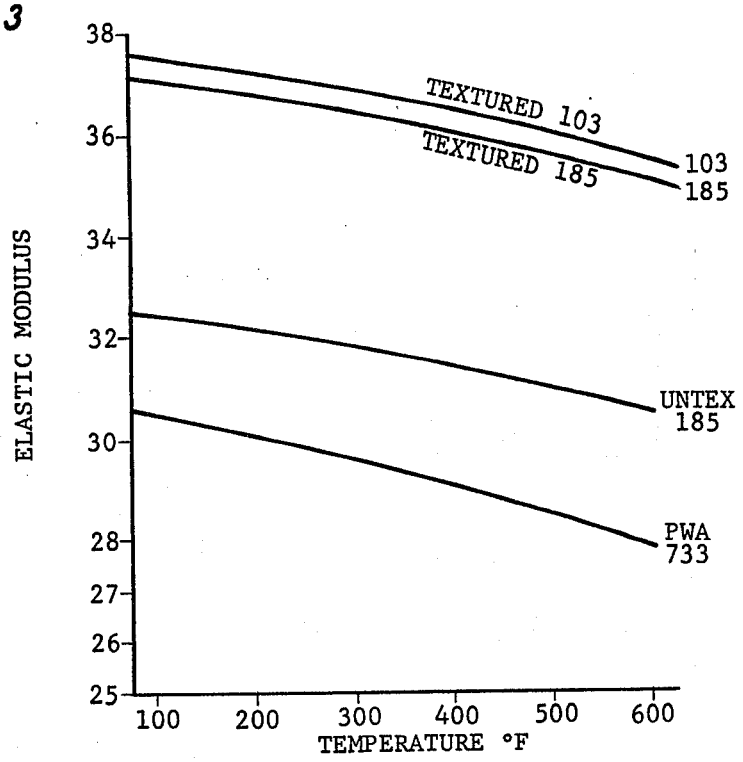
FIG. 3 is a plot of Young's modulus versus temperature for an exemplary material processed according to the present invention as well as prior art material.

FIG. 3 is a plot showing the Young's modulus of Alloys 103 and 185 (which satisfy the criteria for the present invention) which have been processed according to the present invention along with a curve for Alloy 185 processed in a manner which results in essentially a random texture. For comparison, a curve showing the modulus of PWA 733 which is a commonly used steel shaft material, is also presented. It can be seen that over the range of temperature up to about 600° F. (316° C.), the textured material produced according to the present invention displays a substantial improvement in Young's modulus over the prior art material as well as the untextured material.

Figure 4:
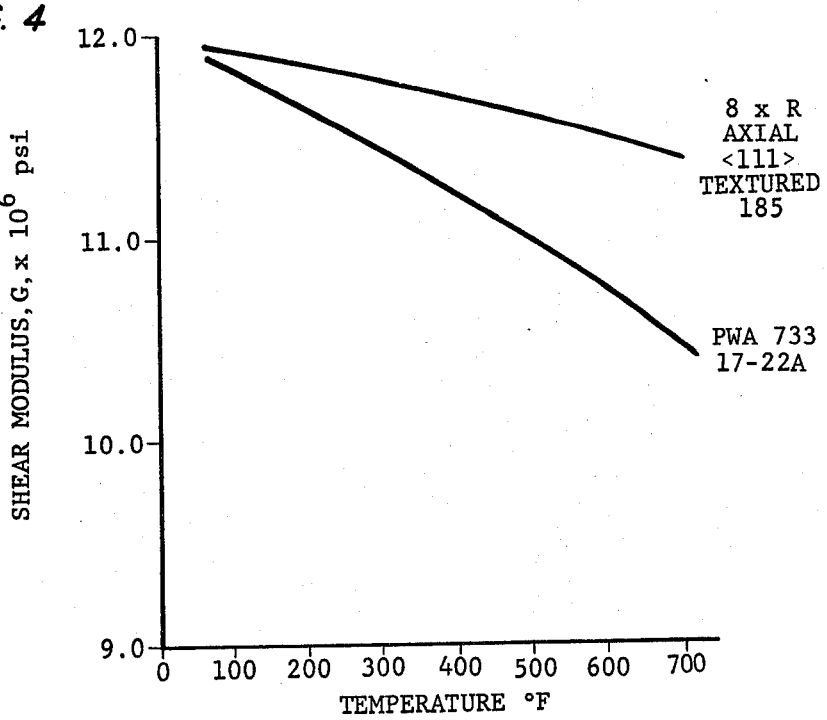
FIG. 4 is a plot of Shear modulus as a function of temperature for an exemplary material processed according to the present invention as well as prior art material.

It might be thought that emphasizing the <111> texture in the axial direction might lead to detriments in other material properties, for example, in the shear properties of material. FIG. 4 shows the shear modulus of textured Alloy 185, again compared with the prior art PWA 733 iron base material. It can be seen that over the range of temperature up to about 600° F. (316° C.), the textured material displays a superior shear modulus and that the superiority in shear modulus increases with increasing temperature.

Figure 5:
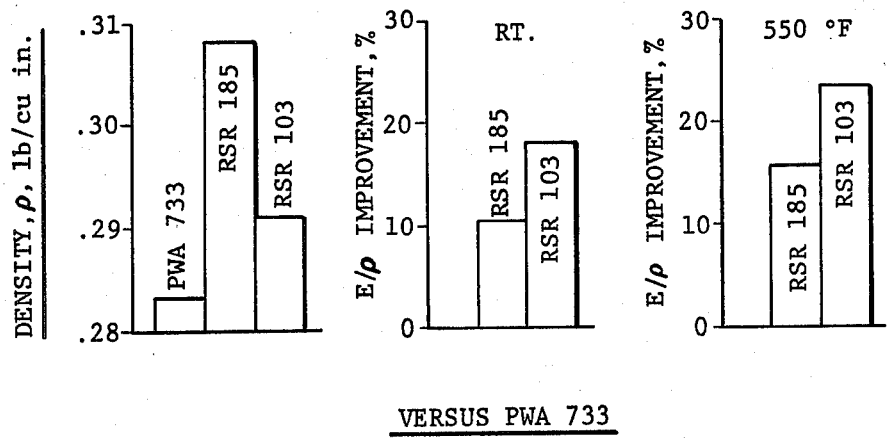
FIG. 5 shows the density of exemplary invention materials as well as the modulus of elasticity normalized by density for materials processed according to the present invention as well as certain prior art materials.

In rotating machinery applications, the significance of many material properties is affected by its density. In order to compare the properties of different materials, it is customary to normalize the property by dividing by the density. FIG. 5 shows the relative density of the prior art PWA 733, the 185 and 103 Alloys, and it is seen that the Alloys 185 and 103 are more dense than the prior art iron base material. However, when one divides the density into the elastic modulus at either room temperature or 550° F. (288° C.), one can see that the alloys of the invention display at least a 10% benefit in density normalized modulus of elasticity, and under some conditions, up to about a 23% improvement in density normalized modulus of elasticity.

In addition to the material properties shown in the previous Figures, experimental testing has shown that the alloys such as Alloy 185 of the present invention display a substantial improvement in fatigue properties when compared with the prior art material; that they have a coefficient of thermal expansion which accurately matches the coefficient of thermal expansion of the steel materials used to produce bearings, so that over a wide range of temperatures, bearing fit and performance should be unaffected; and that the materials have good tensile properties over the range of temperatures which would be encountered in use.

Accordingly, the present invention comprises a class of materials which can be processed according to a particular schedule so as to produce shafts having a high modulus of elasticity in the axial direction as a consequence of having a <111> texture in the axial direction, which is at least five times that which would be encountered in randomly oriented material.

Although this invention has been shown and described with respect to detailed embodiments thereof, it will be understood by those skilled in the art that various changes in form and detail thereof may be made without departing from the spirit and scope of the claimed invention.

TABLE I

| | Nominal Alloy Compositions (wt %) | | | | | | | | | | |
|---|---|---|---|---|---|---|---|---|---|---|---|
| Alloy | Mo | Al | W | Cr | C | B | Zr | V | Mn | Ni | Fe |
| 103 | 14.4 | 6.8 | | | 0.04 | | | | | Bal | |
| 116* | | 8.33 | 9.46 | 9.16 | 0.05 | | | | | Bal | |
| 185 | 14.4 | 6.8 | 6.25 | | 0.04 | | | | | Bal | |
| 607** | 10 | 6.6 | 6 | | 0.04 | 0.01 | | | | Bal | |
| PWA 733* | 0.55 | | | 0.95 | 0.45 | | 0.04 | 0.35 | 0.55 | | Bal |

*outside of invention
**borderline composition

We claim:

1. An article which comprises:

a nickel base alloy containing more than about 30 volume percent of a strengthening phase of the $Ni_3X$ type, said alloy having a moderate to high stacking fault energy, said article having a <111> texture which is at least five times random along a particular axis and a high modulus of elasticity along the same axis.

2. An article as in claim 1 having a composition consisting essentially of 6–18% molybdenum, 0–10% chromium, 3–10% aluminum, 0–10% tungsten, 0–6% tantalum, 0–6% columbium, balance essentially nickel.

3. A method of producing an article having a high modulus of elasticity along a certain axis which comprises:

providing as a starting material a nickel base alloy having a moderate to high stacking fault energy and containing at least about 30 volume percent of a phase of the $Ni_3X$ type;

hot deforming the material in an axisymmetric manner about the axis along which the high modulus is desired to produce a singular <111> texture along said axis;

cold deforming the material in an axisymmetric manner about the axis along which the high modulus is desired, whereby the <111> texture is intensified to at least five times random, and an enhanced modulus of elasticity along the desired axis results.

4. A method as in claim 3 in which the alloy has a composition consisting essentially of 6–18% molybdenum, 0–10% chromium, 2–10% aluminum, 0–10% tungsten, 0–6% tantalum, 0–6% columbium, balance essentially nickel.

5. A method as in claim 3 in which the starting material is in powder form and is placed in a deformable container and hot extruded an amount in excess of 15:1.

6. A method as in claim 3 in which the amount of hot axisymmetric deformation is in excess of about 10:1.

* * * * *